United States Patent [19]

Coyle

[11] 4,247,244

[45] Jan. 27, 1981

[54] TRANSFER MECHANISM

[76] Inventor: Terrence W. Coyle, 108 Beach Dr., Prospect, Conn. 06712

[21] Appl. No.: 936,332

[22] Filed: Aug. 24, 1978

[51] Int. Cl.[3] ..... B65G 65/04

[52] U.S. Cl. ..... 414/753; 294/99 S; 294/106

[58] Field of Search ..... 294/103 R, 86.32, 99 R, 294/99 S, 106; 414/451, 453, 753

[56] References Cited

U.S. PATENT DOCUMENTS 2,486,085 10/1949 Whitmore et al. ..... 414/753

2,836,313 5/1958 Yeo et al. ..... 414/753

3,935,950 2/1976 Burch ..... 414/753

*Primary Examiner*—Lawrence J. Oresky

[57] ABSTRACT

A transfer mechanism for use in a header wherein transfer fingers are mounted in a horizontally movable finger head in a manner such that each finger can be deflected, as needed, to engage a workpiece, e.g., at the cut-off station, whether or not it has been accurately positioned, the workpiece being then automatically placed in the proper position for transferring accurately to the next station.

9 Claims, 6 Drawing Figures

TRANSFER MECHANISM

This invention relates to a transfer mechanism for use in a header and is concerned particularly with the provision of transfer fingers adapted to pick up a piece of wire which has been cut by the cut-off knife and randomly positioned at the push-out station, the wire workpiece being automatically adjusted to an accurate position by means of the interaction of the transfer fingers. As shown, the transfer fingers are mounted in a horizontally movable finger head and each finger can be deflected to engage the workpiece while being strongly biased toward an adjusted position which ensures accurate delivery of the workpiece to the first die.

It is customary to provide transfer fingers which are rigidly mounted and capable of fine adjustment, as required, for accurate delivery of workpieces to successive dies but such fingers are not adapted to pick up a workpiece which may be somewhat displaced from its predetermined intended position, as may occur particularly at the cut-off die.

It is accordingly an object of the present invention to mount the first transfer fingers with sufficient resiliency to enable them to deflect slightly in order to engage a misplaced workpiece and to move the workpiece automatically into its proper adjusted position while delivering it to the next die.

It is a further object of the invention to provide simple and readily accessible means for adjusting the finger head vertically and horizontally, for accurate determination of the point of delivery of the workpiece.

It is another object of the invention to provide the transfer fingers with sufficient accuracy to enable the workpiece to be inserted in the heading die by the first heading punch.

It is a still further object of the invention to provide certain improvements in the form, construction and arrangement of the several parts whereby the above-named and other objects may effectively be attained.

The invention accordingly comprises the features of construction, combinations of elements, and arrangement of parts which will be exemplified in the constructions hereinafter set forth, and the scope of the invention will be indicated in the claims.

A practical embodiment of the invention is shown in the accompanying drawings, wherein.

Figure 1:
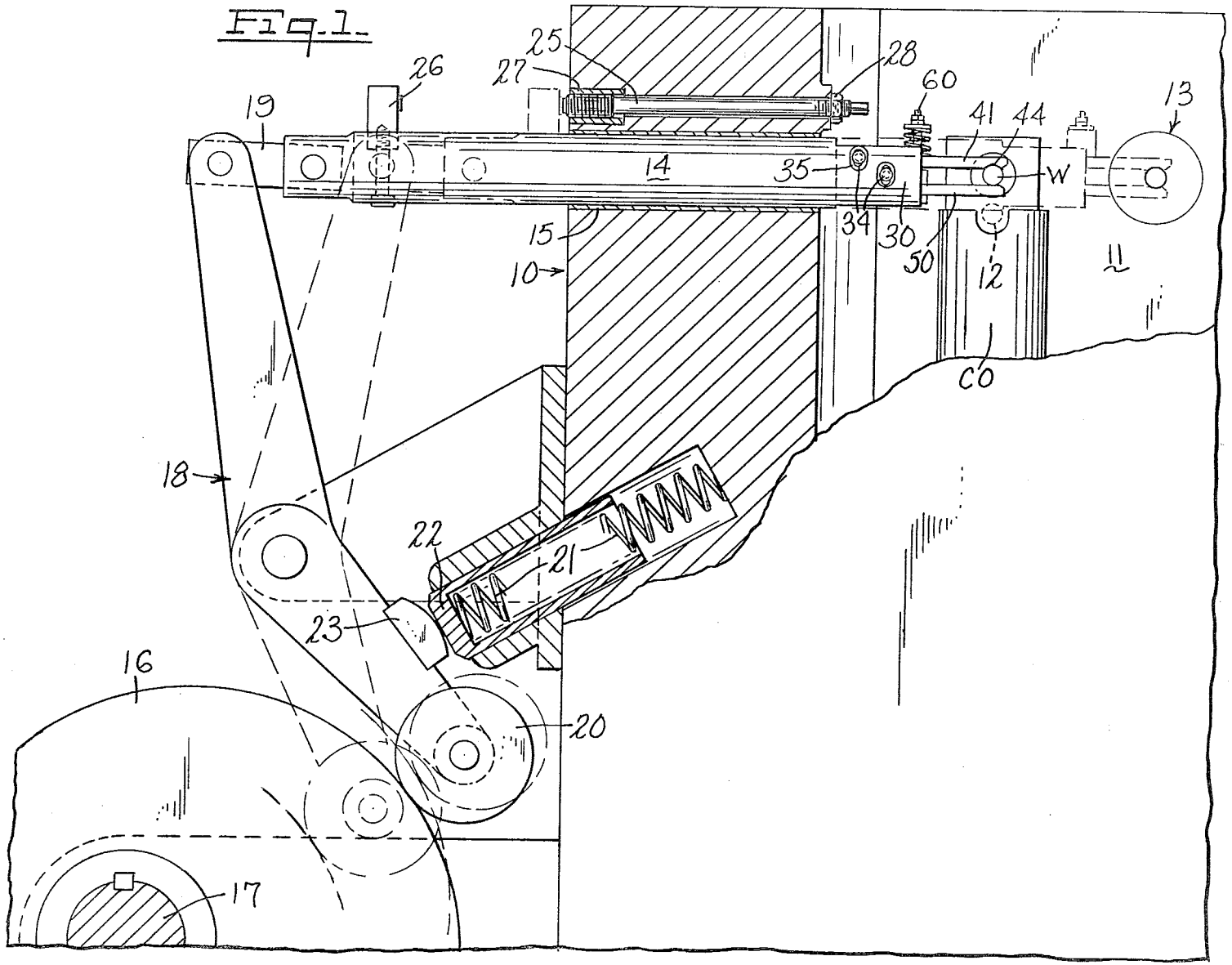
FIG. 1 represents a transverse vertical sectional view of a portion of a header or the like showing the transfer mechanism adapted to transfer a workpiece (wire) from the cut-off die to the first working die.
Figure 2:
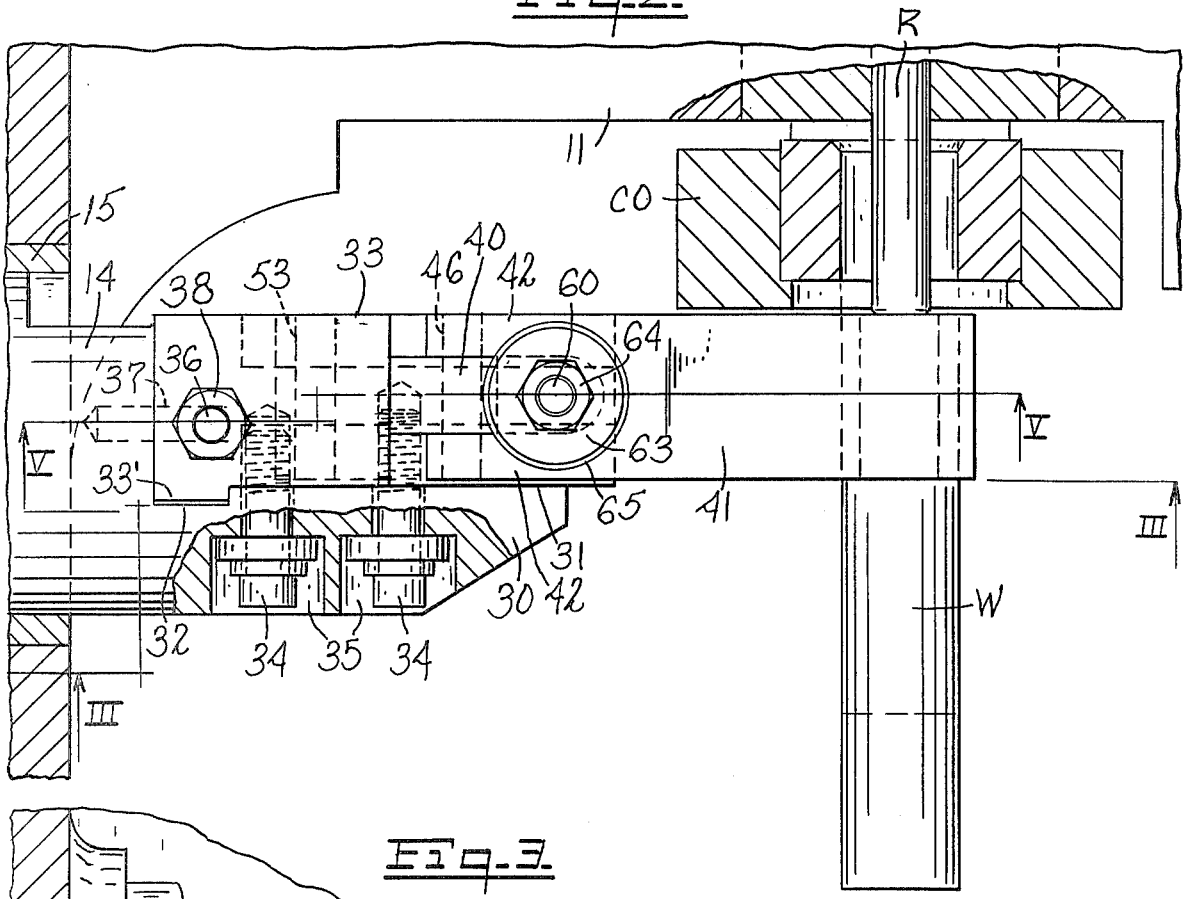
FIG. 2 represents a detail top plan view of the transfer fingers and finger head, parts being broken away.

Referring to the drawings, a portion of the frame of a header or like machine is shown at 10, adjacent the die block 11 in which are located a cut-off die 12 and a first working (heading) die 13. The transfer bar 14 is horizontally slidable in the bushing 15 and is actuated by the cam 16 on the side shaft 17 which rocks the bell crank 18, the upper arm of which is connected to the transfer bar by a link 19. The lower arm of the crank carries a roll 20, constituting the cam follower, which is held in contact with the cam surface by the action of spring 21 on the plunger 22, bearing against the pad 23 on the lower arm of the crank.

The transfer bar drive is so arranged that retraction, by counterclockwise movement of the crank, is positive, while advancement, by clockwise movement of the crank, is effected by the force of the spring 21, the precise limit of forward travel being determined by means of the adjusting screw 25, the end of which is contacted by the stop post 26 mounted on the top of the transfer bar. The screw 25 is threaded in a bushing 27, set in the machine frame, and is locked in adjusted position by means of the lock nut 28 on its protruding opposite end.

At its forward end the transfer bar is provided with a projecting seat 30 having a vertical wall 31 and vertical track 32. The finger head 33 is mounted on the wall 31 by means of cap screws 34 with the flange 33'fitting in the track 32. The sockets 35 for the cap screws are vertically elongated to permit some vertical adjustment of the finger head relative to the transfer bar, the adjusted height being established by means of the set screw 36 threaded vertically in the finger head with its lower end resting on a pin 37 in the transfer bar. The nut 38 locks the set screw in its adjusted position.

The finger head 33 has a main body portion, in the side of which the screws 34 are threaded, and a forwardly projecting tongue 40 on which the upper transfer finger and the retaining springs are mounted. The upper finger 41 is a flat bar, bifurcated adjacent its rear end to form arms 42 straddling the spring assembly and provided at its forward end with a forwardly facing cam surface 43 and an inverted V-shaped socket 44 for engagement with the workpiece W. The arms 42 are cylindrically grooved to form seats 45 adapted to engage the upper portion of a horizontally disposed pivot pin 46. The lower finger 50 is also a flat bar bifurcated throughout more than half its length to form arms 51 having at their rear ends cylindrical grooves which form seats 52 adapted to engage the horizontal pivot pin 53 which projects on either side of the depending portion 33'' of the finger head.

The transfer fingers are held on the finger head entirely by the forces developed in the spring assembly which comprises a vertical post 60 having a square block 61 on its lower end, between the arms 51, a cross-bar 62 extending transversely through the block, a washer 63 and two nuts 64 on its upper end and springs 65, 66 under compression beneath the washer. The outer spring 65 presses downward on the upper surface of the upper finger, holding the seats 45 securely engaged with the pivot pin 46 while permitting limited pivotal movement of the finger around the axis of the pivot pin as a center. The inner, longer spring 66 rests on the upper surface of the tongue 40 and acts to urge upward the cross-bar 62 bearing on the arms 51 and thus holding the seats 52 securely engaged with the pin 53 while permitting limited downward pivotal movement of the lower finger around the axis of the pivot pin as a center. At the rear end of the lower finger, adjacent the seats 52, the ends of the arms 51 are slightly beveled to permit such movement and at the forward end of the finger its upper corner is slightly beveled to facilitate engagement with a workpiece. The block 61 has a free sliding fit in the space between arms 51 so that the cross-bar 62 is retained in position transversely of the finger, and the post 60 has a free sliding fit in the tongue 40 to permit downward movement of the post upon downward deflection of the lower finger.

Figure 3:
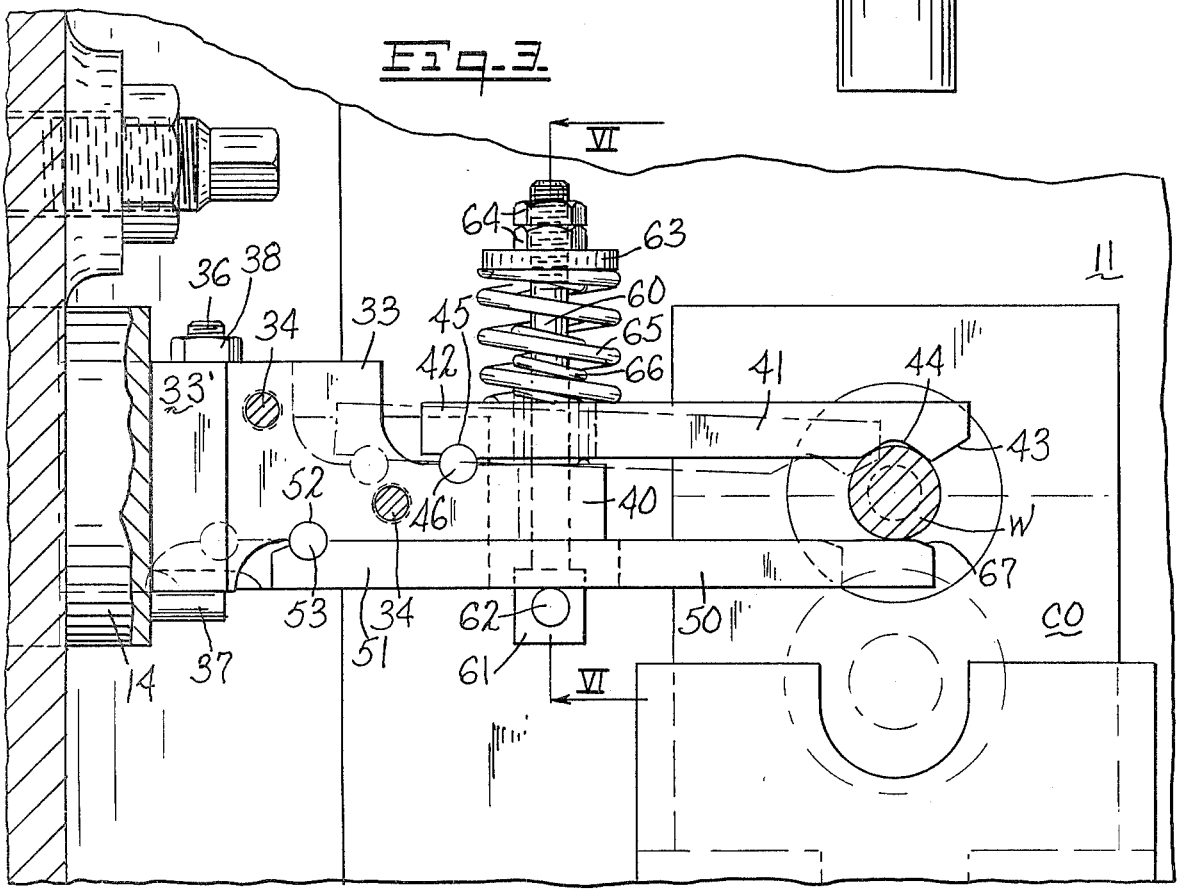
FIG. 3 represents a detail vertical section on the line III—III of FIG. 2, looking in the direction of the arrows.
Figure 4:
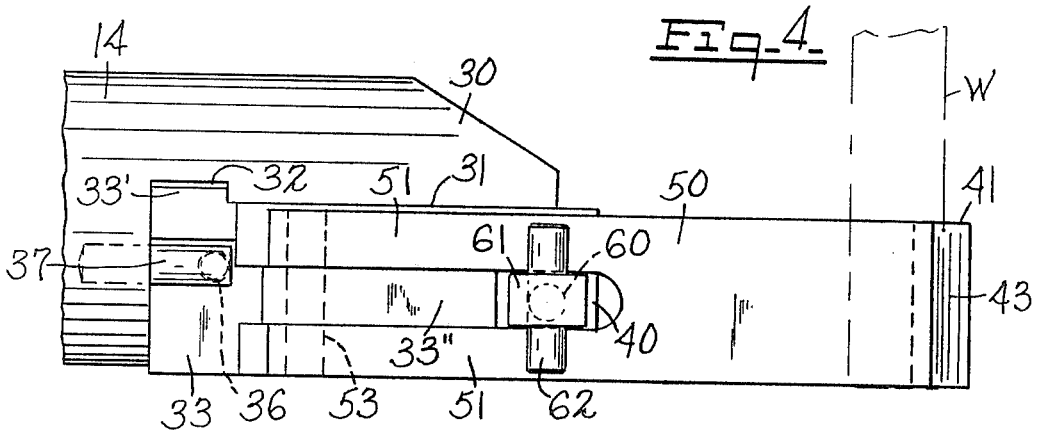
FIG. 4 represents a detail bottom plan view of the transfer fingers.
Figure 5:
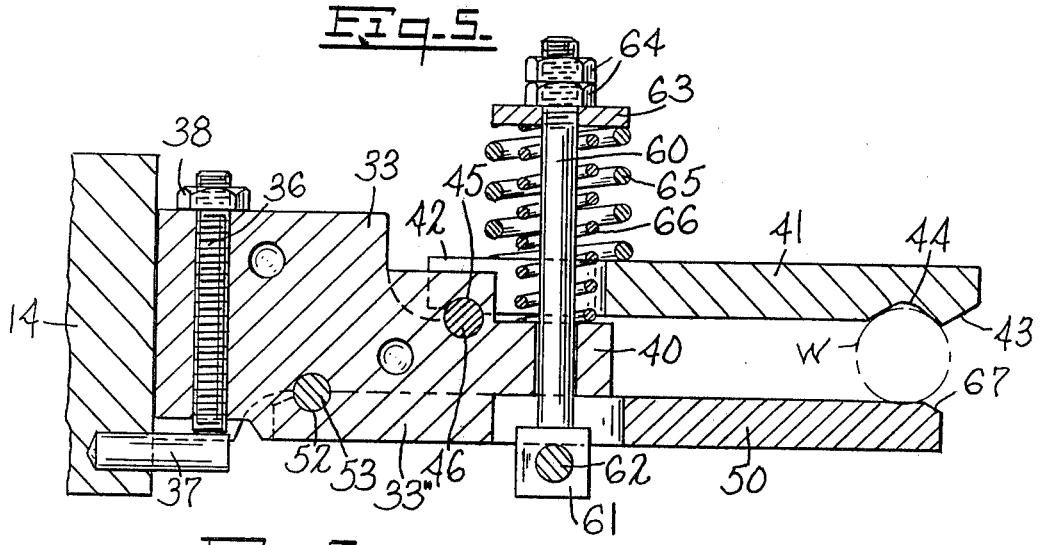
FIG. 5 represents a detail vertical section on the line V—V of FIG. 2.
Figure 6:
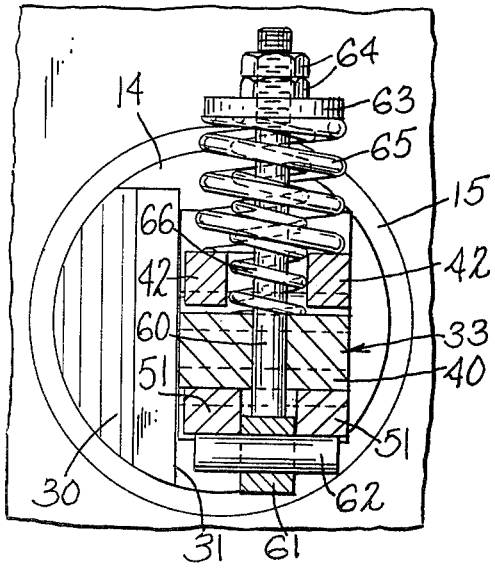
FIG. 6 represents a detail vertical section on the line VI—VI of FIG. 3.

In operation, the transfer bar is actuated by its cam to retract the fingers slightly, to the position indicated in broken lines in FIG. 3, the cut-off knife CO cuts a length of wire at the cut-off die 12 and lifts the cut workpiece to a position opposite the push-out station, and the push-out rod R is actuated as the fingers advance to grip the workpiece.

The slanting cam surface 43 at the end of the upper finger and the bevel 67 at the end of the lower finger increase the effective spacing of the fingers and their resilient mountings enable them to deflect sufficiently to engage reliably with any workpiece which is out of its perfectly aligned position. When the peak of the cam surface 43 has ridden over the high point of the workpiece, the latter will rest accurately in the V-shaped socket 44 as the fingers return to normal position for transfer, and the advancement of the transfer bar will then place the workpiece in precise alignment in front of the first heading die 13 so that the first punch can insert it in the die.

When the workpiece has been taken from the cut-off knife, its position is determined by the position of the lower finger, at rest against the tongue 40 of the finger head, because the spring 66 acting on cross-pin 62 at a substantial distance from pivot pin 53 has a lever arm which easily takes control from the spring 65, acting on the upper finger at a point close to the pivot pin 46. Thus the adjustment of the height of the finger head and the throw of the transfer bar can be made reliably in reference to the surface of the lower finger, as to height, and the center line of the socket 44, as to distance. Each workpiece will be automatically located in a uniform position on that surface and centered in that socket, even though it may have been picked up at the cut-off station in a slightly aberrant position.

As an added advantage, the upper finger automatically adjusts to workpieces of different sizes, so that a single upper finger can be used for a range of sizes upward from a minimum wherein the diameter of the workpiece barely exceeds the spacing between the lower finger and the socket 44 at rest. Removal, repair and replacement of the fingers can easily be effected by relieving the spring pressure and slipping the fingers off their pivot pins.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

What I claim is:

1. In a header, a transfer mechanism comprising, a horizontally slidable transfer bar, drive means for moving said bar in the direction of workpiece transference, a transfer finger head adjustably mounted on said bar, means for effecting vertical adjustment of the finger head on the bar, upper and lower transfer fingers in pivotal engagement adjacent their rear ends with the transfer finger head, each finger having a work engaging surface adjacent its forward end, a first spring biasing the upper finger downward, a second spring biasing the lower finger upward, said springs being capable of exerting substantially unequal effective biasing forces, and means on the transfer finger head limiting the movement of said fingers.

2. A transfer mechanism according to claim 1 wherein at least one transfer finger is provided with a cam surface in a position to engage a misplaced workpiece.

3. A transfer mechanism according to claim 2 wherein the cam surface is on the upper finger and the work engaging surface of said finger includes a V-shaped socket portion adjacent the cam surface.

4. A transfer mechanism according to claim 3 wherein the workpiece engaging surface of the lower finger terminates in a beveled edge.

5. A transfer mechanism according to claim 1 wherein the springs are coaxially mounted helical springs under compression.

6. A transfer mechanism according to claim 5 wherein the spring biasing the lower finger upward exerts substantially more effective force than the spring biasing the upper finger downward.

7. A transfer mechanism according to claim 1 wherein the means limiting the upward movement of the lower finger is a bottom surface of the transfer finger head.

8. A transfer mechanism according to claim 1 wherein the pivotal engagement of each finger with the transfer finger head comprises a horizontally disposed pivot pin on the transfer finger head and a groove in the surface of the finger adapted to engage the respective pivot pin.

9. A transfer mechanism according to claim 8 wherein the fingers are held in engagement with the pivot pin entirely by the forces of the first and second springs.

* * * * *